US010969212B1

(12) United States Patent
Rophael et al.

(10) Patent No.: US 10,969,212 B1
(45) Date of Patent: Apr. 6, 2021

(54) MULTIPURPOSE MUNITION FOR PERSONNEL AND MATERIEL DEFEAT

(71) Applicant: U.S. Government as Represented by the Secretary of the Army, Picatinny Arsenal, NJ (US)

(72) Inventors: David Rophael, Lafayette, NJ (US); Jeffrey Darbig, Flanders, NJ (US); Thomas Presutti, Long Valley, NJ (US); Daniel DiMartino, Wayne, NJ (US); Nicole Sapp, Augusta, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/674,191

(22) Filed: Nov. 5, 2019

Related U.S. Application Data

(63) Continuation-in-part of application No. 16/165,366, filed on Oct. 19, 2018, now Pat. No. 10,502,537.
(Continued)

(51) Int. Cl.

| | |
|---|---|
| ***F42C 1/04*** | (2006.01) |
| ***F42B 12/06*** | (2006.01) |
| ***F42B 12/20*** | (2006.01) |
| ***F42B 12/38*** | (2006.01) |
| *F41H 11/02* | (2006.01) |
| *F42C 1/10* | (2006.01) |

(52) U.S. Cl.
CPC ..... *F42C 1/04* (2013.01); *F42B 12/06* (2013.01); *F42B 12/208* (2013.01); *F42B 12/38* (2013.01); *F41H 11/02* (2013.01); *F42C 1/10* (2013.01)

(58) Field of Classification Search
CPC ..... F42B 12/02; F42B 12/04; F42B 12/06; F42C 1/06; F42C 15/24; F42C 1/00; F42C 1/02; F42C 1/04; F42C 1/08
See application file for complete search history.

(56) References Cited

U.S. PATENT DOCUMENTS 3,677,181 A 7/1972 Giljarhus
3,952,663 A * 4/1976 Forst ..... F42C 19/00 102/275

(Continued)

FOREIGN PATENT DOCUMENTS

DE 1155036 B * 9/1963 ..... F42C 15/24
DE 2051186 A1 * 4/1972 ..... F42C 1/08

(Continued)

OTHER PUBLICATIONS

English translation of DE 2051186 (Year: 1972).*

*Primary Examiner* — Joshua T Semick
(74) *Attorney, Agent, or Firm* — John P. DiScala

(57) ABSTRACT

An ammunition round comprises an optimized projectile incorporating a hardened penetrator and a dual safe-fuze for a medium caliber high rate of fire round packaged into a form factor smaller than currently available multi-purpose rounds. The ammunition round incorporates a hardened segment penetrator followed by a point detonated high explosive warhead that substantially increases the terminal performance against both materiel and personnel targets. The hardened segment penetrator localizes the kinetic, energy of the projectile to increase target penetration prior to the initiation of the high explosive warhead.

7 Claims, 8 Drawing Sheets

Related U.S. Application Data

(60) Provisional application No. 62/574,794, filed on Oct. 20, 2017.

(56) References Cited

U.S. PATENT DOCUMENTS

| | | | | | |
|---|---|---|---|---|---|
| 4,004,521 | A | * | 1/1977 | Andrejkovics | F42C 1/04 102/267 |
| 4,237,788 | A | * | 12/1980 | Hagen | F42C 1/02 102/245 |
| 4,242,964 | A | * | 1/1981 | Warren | F42C 19/00 102/245 |
| 4,466,351 | A | * | 8/1984 | Strobush | F42C 1/02 102/239 |
| 5,591,935 | A | * | 1/1997 | Shamblen | F42C 1/08 102/216 |
| 8,250,987 | B1 | | 8/2012 | Morley | |
| 8,640,624 | B1 | | 2/2014 | Hassan | |
| 9,329,008 | B1 | | 5/2016 | Gilbert | |
| 2002/0152914 | A1 | | 10/2002 | Cox | |
| 2007/0017409 | A1 | | 1/2007 | Mansfield | |
| 2012/0216699 | A1 | | 8/2012 | Fanucci | |

FOREIGN PATENT DOCUMENTS

| | | | | | |
|---|---|---|---|---|---|
| GB | 606475 | A | * | 8/1948 | F42C 1/06 |
| GB | 708351 | A | * | 5/1954 | F42C 1/06 |
| GB | 744564 | A | * | 2/1956 | F42C 9/141 |
| GB | 1214040 | A | * | 11/1970 | F42B 14/064 |

* cited by examiner

MULTIPURPOSE MUNITION FOR PERSONNEL AND MATERIEL DEFEAT

CROSS-REFERENCE TO RELATED APPLICATIONS

This application is a continuation-in-part of U.S. patent application Ser. No. 16/165,366 filed on Oct. 19, 2018 which claims the benefit under 35 USC § 119(e) of U.S. provisional patent application 62/574,794 filed on Oct. 20, 2017.

STATEMENT OF GOVERNMENT INTEREST

The inventions described herein may be manufactured, used and licensed by or for the United States Government.

BACKGROUND OF THE INVENTION

The invention relates in general to ammunition and in particular to medium caliber ammunition.

Military installations face increased risk from rockets, artillery, and mortar (RAM) threats. To protect against these threats, Counter rocket, artillery and mortar (C-RAM) systems are employed to engage incoming RAM threats. The need for increased performance from C-RAM systems arises as new or improved threats emerge.

One medium caliber ammunition currently used in C-RAM systems was initially developed as an anti-aircraft munition and optimized to destroy thin skinned targets. As such, the activation mechanism in the round is sensitive and may initiate the high explosive in the warhead prior to penetration into RAM targets. Another round currently used by naval systems for a similar mission utilizes a sub-caliber tungsten penetrator to increase performance; however, this solution lacks a self-destruct mechanism which is necessary for a land-based system to ensure unengaged falling rounds do cause unintended damage. Accordingly, a need exists for a medium caliber cartridge solution that targets emerging RAM threats with improved penetration and detonation delay. Additionally, the ammunition requires tracer and self-destruct features for use in a land-based system.

In addition to the issues posed by RAM threats, the versatile roles filled by many military weapon systems present another need for an improved medium caliber munition. There is currently no multi-purpose Munition in the 20 mm size which can be employed against both personnel and armored materiel targets. Current medium caliber rounds employed against personnel targets contain outdated components and lack armor piercing capabilities, Conversely, medium caliber rounds used for materiel defeat are unfuzed and lack the explosive power to produce high velocity fragments.

Without a multi-purpose munition, weapon systems may be required to carry a mixed belt of ammunition. This increases time to engagement, as well as greatly increases the overall weight of ammunition the weapon system must carry to achieve an equivalent number of stowed kills.

Accordingly, a need exists for a medium caliber cartridge solution that may be used to defeat both personnel and armored materiel targets.

SUMMARY OF INVENTION

One aspect of the invention is a projectile for an ammunition round. The projectile includes a nose assembly and a warhead assembly. The nose assembly further comprises a hardened penetrator and a nose body. The hardened penetrator is positioned at a forward end of the nose assembly and further comprises a body having a conical portion and a stepped down cylindrical portion. A rear surface of the conical portion forms a support rim. The nose body defines a hollow interior. The hollow interior receives the cylindrical portion of the hardened penetrator in a forward opening. A forward surface of the nose body is in contact with the support rim of the hardened penetrator. The warhead assembly is rearward of the nose assembly and further comprises a fragmenting body, a point detonating fuze and an explosive charge. The fragmenting body defines a main cavity with a forward opening. The point detonating fuze is partially housed within the main cavity of the fragmenting body and the hollow interior of the nose body. The explosive charge is housed within the fragmenting body. The support rim prevents rearward axial translation of the hardened penetrator and upon impact with a target, the support rim is sheared thereby allowing the hardened penetrator to translate rearward in an axial direction thereby engaging a fuze striker to initiate the fuze and detonate the explosive charge.

Another aspect of the invention is a projectile for an ammunition round. The projectile comprises a nose assembly and a warhead assembly. The nose assembly further comprises a nose cap, a nose body and a hardened penetrator. The nose cap is positioned at a forward end of the nose assembly. The nose body is rearward of the nose cap and defines a hollow interior. The hardened penetrator is enclosed within the interior volume of the nose cap and has a hollow longitudinal shaft. The hardened penetrator further comprises a primary striker housed within the hollow longitudinal shaft. The primary striker extends beyond a front surface of the hardened penetrator to contact a rear surface of the nose cap and further comprises a support flange in contact with the front surface of the hardened penetrator. The warhead assembly is rearward of and partially received within the nose assembly and further comprises a fragmenting body, a point detonating fuze and an explosive charge. The fragmenting body defines a main cavity with a forward opening. The point detonating fuze is partially housed within the main cavity of the fragmenting body and the hollow interior of the nose body. The explosive charge is housed within the fragmenting body. The support rim of the primary striker prevents rearward axial translation of the primary striker and upon impact with a target, the support rim is sheared thereby allowing the primary striker to translate rearward in an axial direction thereby engaging a fuze striker to initiate the fuze and detonate the explosive charge.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Medium Caliber Multi-Purpose Traced Self-Destruct Projectile

Figure 1:
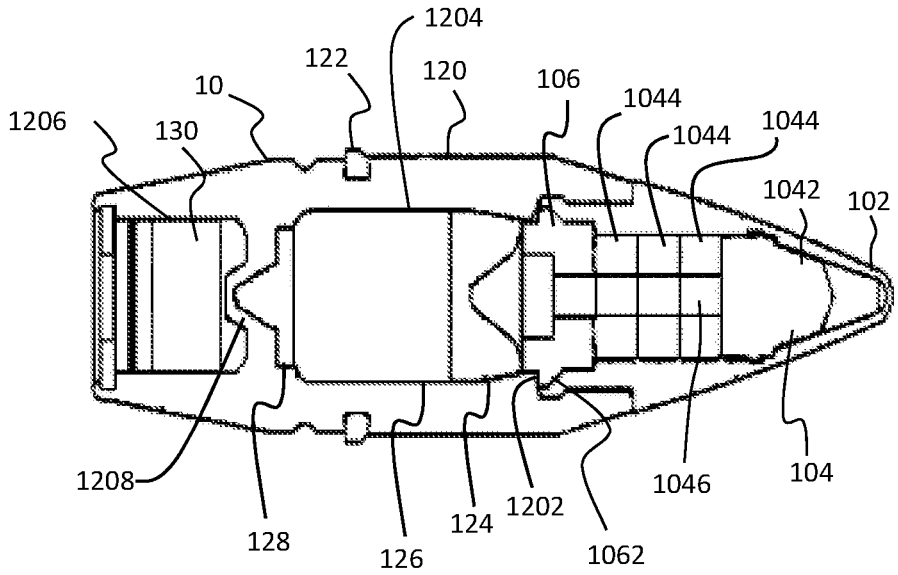
FIG. 1 is a side cross-sectional view of a medium caliber multi-purpose traced self-destruct projectile with a four piece solid penetrator design, in accordance with one embodiment.

A medium caliber high rate of fire ammunition round includes an optimized projectile incorporating a hardened segmented penetrator and an explosive self-destruct mechanism. This combination of hardened penetrator and self-destruct mechanism satisfies the dual needs of increased lethality with minimization of unintended harm. The self-destruct mechanism, in particular, is required for use in U.S. military land based C-RAM systems and allows for use over friendly forces.

The hardened segmented penetrator and the precisely tuned synergy between the segmentation penetrator, closure plug and the explosive warhead to appropriately time the initiation of the explosive are key to effectiveness. The hardened segmented penetrator is followed by a pyrotechnically initiated high explosive warhead that substantially increases the effective range and terminal performance against RAM targets. The hardened segment penetrator localizes the kinetic energy of the projectile to increase target penetration prior to the initiation of the high explosive warhead.

The projectile integrates a unique forward nose assembly that includes a hardened segmented penetrator and engineered closure plug. This combination of specifically designed projectile features can be leveraged across all medium caliber ammunition with a similar mission. This segmentation of the penetrator reduces collateral damage on nearby infrastructure from rounds that do not engage the target and undergo self-destruct. The segmented penetrator, although made up of multiple pieces, acts like a solid mass when engaging the target.

The penetrator ensures that the round penetrates the hardened targets without premature initiation of the high explosive warhead and that the high explosive initiates only after penetration into the hardened target. This allows for improved terminal performance of the high explosive once initiated within the target.

The lead penetrator section is specifically designed to increase oblique angle penetration onto the target surface and ensure that the round does not ricochet off of the target during engagement. This penetrator can be arranged in multiple configurations and could utilize any number of segments based on the ammunition ballistic and terminal requirements. Further, the lead penetrator segment can be solid or hollow. A hollow lead penetrator allows for the inclusion of a small amount of incendiary which makes the round much more versatile. The incendiary allows for initiation of the round on softer aluminum targets in addition to providing the extra penetration capabilities of the hardened penetrator needed to defeat the larger targets.

The base penetrator segments are hollow to allow pressure from the explosive to rupture the ogive during self-destruction. This allows for the capability to reduce projectile fragments to non-lethal impact limits.

In embodiments of the invention, the hardened segmented penetrator is manufactured with materials including heavy tungsten alloy, reactive material and alloy steel. However, the hardened segmented penetrator is not limited to being manufactured from among these materials.

The closure plug between the penetrator and projectile body translates the target impact forces to appropriately initiate the high explosive payload to maximize terminal performance. The closure plug geometry and composition can be tailored to optimize the initiation timing of the warhead and to provide additional penetration capability.

As described in further detail below, there are multiple embodiments of the projectile. Four embodiments are shown and described below which utilize a 20×120 mm cartridge configuration as a demonstration platform. However, the projectile is not limited to use within a 20×120 mm cartridge configuration. Further while the projectile is particularly suited for a medium caliber C-RAM system, the projectile is not limited to C-RAM roles or to medium caliber ammunition. The projectile may be employed in a small caliber ammunition round or large caliber ammunition round.

Tests performed on ammunition rounds incorporating the projectile have shown dramatic improvement over legacy solutions. The inclusion of the hardened segmented penetrator and the dynamic interaction of the closure plug provides dramatically increased performance on large rockets and mortars compared to legacy solutions including the M940 ammunition round.

FIG. 1 is a side cross-sectional view of a medium caliber multi-purpose traced self-destruct projectile with a four piece solid penetrator design, in accordance with one embodiment. The projectile 10 comprises a forward nose assembly, a warhead assembly and a tracer assembly. The forward nose assembly is sized and dimensioned to be partially received into a corresponding opening in the warhead assembly. The tracer assembly is entirely housed within an opening in the rear of the warhead assembly.

The forward nose assembly further comprises a nose cap 102 and a hardened segmented penetrator 104 including a penetrator tip 1042 and one or more penetrator bases 1044 and a closure plug 106. The nose cap 102 includes internal threads to support the threaded hardened segmented penetrator 104 and to efficiently transfer launch loads to the projectile body 120. The nose cap 102 provides an aerodynamic surface and houses the hardened segmented penetrator 104 during flight. The nose cap 102 is formed of a material with increased hardness when compared to legacy solutions. This allows for proper assembly and rigidity during launch while still allowing the penetrator 104 to break up during self-destruct to minimize collateral damage.

The hardened segmented penetrator 104 comprises a penetrator tip 1042 and one or more penetrator bases 1044. The hardened segmented penetrator 104 may be manufactured from among multiple materials including heavy tungsten alloys, reactive material and alloy steel.

The penetrator tip 1042 may be made of multiple materials and is specifically designed to dig into the outer casing of the target and prevent the round from ricocheting off of the target. In the embodiment shown in FIG. 1, the penetrator tip 1042 is made of a heavy metal, such as a tungsten alloy. The penetrator tip shown in FIG. 1 is generally conical in shape and forming a point at the forward end, or the end closest to the nose of the projectile. The penetrator tip 1042 is positioned forward of and aligned with the one or more penetrator bases 1044.

The one or more penetrator bases 1044 add to the mass and rigidity of the penetrator 104 during launch. There can be multiple penetrator bases 1044 which are stacked next to each other and designed to break apart. For example, while the embodiment shown in FIG. 1 includes four penetrator bases 1044, the projectile 10 is not limited to four penetrator bases 1044 and may include more than or less than four depending on application and desired performance. In the embodiment shown, the one or more penetrator bases 1044 are annular cylindrical discs with the central hole which aids in self-destruct performance. When the bases 1044 are assembled in series, the holes align to form a hollow central cavity 1046. As will be described below, during self-destruct, the hollow central cavity 1046 is filled with high pressure gases which cause the segmented penetrator 104 to break apart.

The closure plug 106 retains the segmented penetrator 104 within the forward nose assembly and separates the segmented penetrator 104 from the warhead body. The closure plug 106 can be made of multiple materials chosen to increase the mass of the projectile 10 and move the center of gravity back. Having a center of gravity closer to the center of the projectile 10 positively effects the dispersion and accuracy of the round. The closure plug 106 can also be hollow, solid, or tailored to the specific projectile configuration. As will be described further below, alternate closure plug 106 geometries enhance the interaction with the explosive train and cause the explosive to react with more energy.

The warhead assembly is rearward of the nose cap assembly. The warhead assembly further comprises a body 120, a driving band 122, an initiating charge 124, an explosive charge 126 and a self-destruct initiation charge 128. The driving band 122 extends around the outer circumference of the warhead body 120.

The warhead, body 120 is generally hollow with two interior cavities, a main interior volume 1204 accessed from an opening in the front of the body and another cavity 1206 accessed by an opening in the base of the projectile 10. The opening in the front of the warhead body is sized to partially receive the nose cap assembly. The opening further comprises a rim 1202 which serves as a mating surface to the support rim 1062 of the closure plug 106.

The remaining main interior volume 1204 is filled by an initiating charge 124, an explosive charge 126 and a self-destruct initiation charge 128. The explosive charge 126 is in communication with both the initiating charge 124 and the self-destruct initiation charge 128, with the initiating charge 124 forward of the explosive charge 126 and the self-destruction initiation charge 126 rearward of the explosive charge 128.

A cavity 1206 in the base of the warhead body 120 contains the tracer assembly. The tracer assembly is exposed to the exterior environment through an opening in the base. The tracer assembly further comprises a tracer charge 130.

In operation, a medium caliber ammunition round comprising the projectile 10 is fired from a weapon, usually by electrical or procession initiation. The projectile 10 is initially seated within a cartridge case further comprising a primer charge and a propelling charge. The initiation ignites the primer charge, which in turn ignites the propellant charge. The propellant burns rapidly to build pressure in the cartridge case and accelerates the projectile 10 down the barrel of the weapon. After the projectile 10 is in motion down the barrel, the projectile 10 exits the barrel and flies toward the target.

Upon firing, the tracer charge 130 is initiated by the burning propellant. During a portion of the flight, the tracer charge 130 emits a visible signature through the opening in the base thereby giving an indication of the path of the projectile 10.

Upon engagement with a target, the nose cap of the projectile 10 deforms to expose the penetrator tip 1042 to initiate penetration into the target. The hardened segmented penetrator 104 localizes the kinetic energy of the projectile 10 to increase target penetration. During the penetration event, the impact forces cause the closure plug support rim 1062 to fail which in turn begins the chain for initiation of the explosive charge 126 of the projectile. Once the support rim 1062 fails, the impact forces the closure plug 106 to travel rearward and contact the impact sensitive initiating charge 124, After a delay to allow full entry into the main body of the target, the high explosive 126 is fully initiated by the initiating charge 124. The geometries and material properties of the projectile 10 and their interaction with each other, including the segmented penetrator tip 1042 and bases 1044, closure plug 106 and charges 124, 126, are tailored such that the high explosive charge 126 inflicts maximum damage to the target by delaying the high explosive detonation until the projectile 10 penetrates the target.

After a predetermined time, if the projectile 10 does not engage a target, the self-detonation initiating charge inmates the high explosive charge, the detonation of which causes the projectile 10 to break apart including the segmented penetrator 104. The projectile 10 continues its trajectory for a set duration of time until the pyrotechnic delay tracer charge 130 burns down. The burning of the tracer charge heats a thin web of metal in the projectile body. The heated web of metal, in turn, lights a self-destruct initiating charge 128, a pyrotechnic booster, and ultimately the high explosive charge 126. The pressure from the explosive reaction self-destructs the projectile body 120 and fills the hollow cavity 1046 of the penetrator 104 to break-up the forward nose assembly, including the segmented penetrator 104, into non-lethal components.

Figure 2:
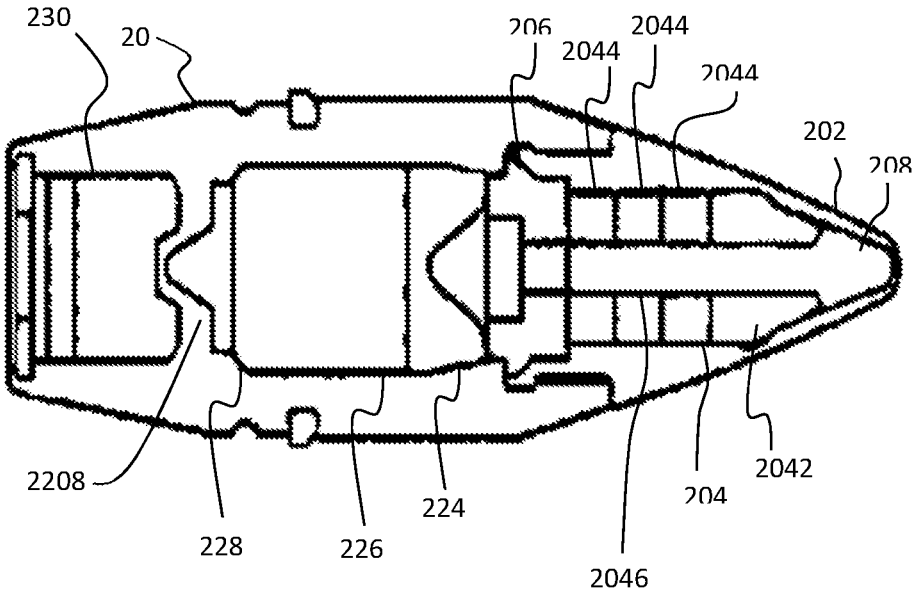
FIG. 2 is a side cross-sectional view of a medium caliber multi-purpose traced self-destruct projectile with a hollow penetrator with incendiary, in accordance with one embodiment.

FIG. 2 is a side cross-sectional view of a medium caliber multi-purpose traced self-destruct projectile with a hollow penetrator and incendiary charge, in accordance with one embodiment. When engaging certain targets, such as targets with thin skin, it may not be desirable to initiate the explosive by contact with the closure plug. Retaining a small amount of incendiary charge 208 in the ogive section of the projectile allows for the initiation of the high explosive charge 226 upon impact with a thin skinned target, such as an aircraft.

The projectile 20 is similar to the projectile 10 shown in FIG. 1 with the warhead assembly and tracer assembly being unchanged; however, as with all of the embodiments, the composition and amounts of the charges may be tailored to the specific performance desired. The hardened segmented penetrator 204 comprises a penetrator tip 2042 with a hollow cavity which aligns with the hollow cavity 2046 of the penetrator bases 2044. The incendiary charge 208 is housed in either or both of the hollow cavities of the hardened segmented penetrator 204.

Upon engagement with a thin skinned target, the nose cap 202 deforms to ignite the incendiary charge 208. The hollow interior of the penetrator tip 2042, penetrator base 2044 and closure plug 206 allow propagation of the incendiary charge 208 through to the initiating charge 224 and explosive charge 226.

If the projectile 20 does not engage a target, the self-destruct mechanism functions as in the projectile 10 of FIG. 1 with the tracer charge heating a web of metal between the tracer charge 230 and the self-destruct initiation charge 228 which in turn ignites the explosive charge 226.

Figure 3:
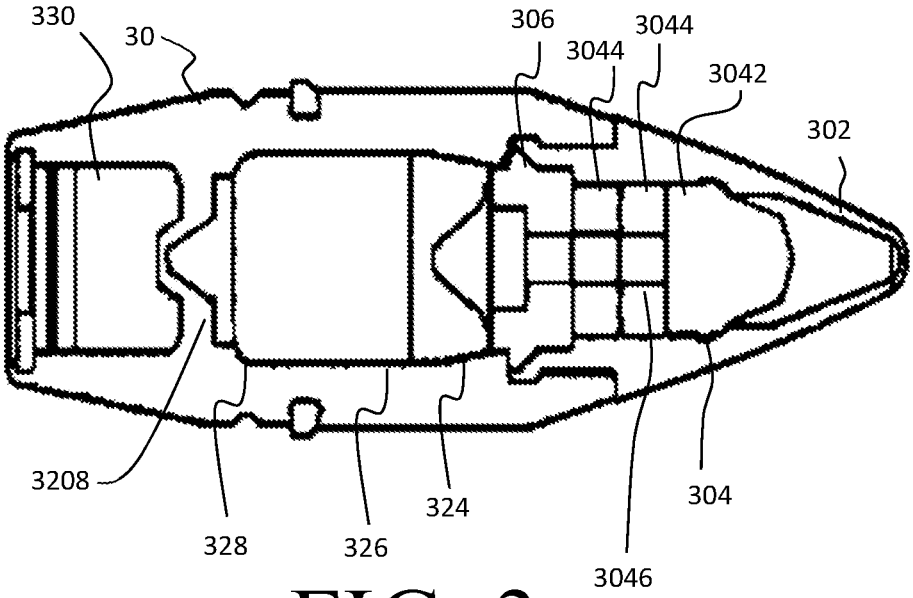
FIG. 3 is a side cross-sectional view of a medium caliber multi-purpose traced self-destruct projectile with a three piece solid penetrator design, in accordance with one embodiment.

FIG. 3 is a side cross-sectional view of a medium caliber multi-purpose traced self-destruct projectile with a three piece solid penetrator design, in accordance with one embodiment. In this embodiment, the penetrator tip incorporates a metal composite, such as a reactive metal, for greater incendiary effect The projectile 30 is similar to the projectile 10 shown in FIG. 1 with the arrangement of the warhead assembly and tracer assembly being unchanged; however, as will all of the embodiments, the composition and amounts of the charges may be tailored to the specific performance desired. The hardened segmented penetrator comprises two bases 3044 and a penetrator tip 3042 which is formed from a material including a reactive metal. The addition of the reactive metal increases the incendiary performance of the projectile in comparison to a heavy metal tip. The penetrator tip with reactive metal is relatively lighter than a heavy metal penetrator and therefore less of a risk in a situation where the round does not engage a target and must self-destruct.

Upon engagement with a target, the energetic chain is initiated and after a predetermined delay, the explosive charge 326 is detonated. The penetrator tip increases the incendiary effect of the round. The penetrator bases may be formed of a heavy metal alloy to increase the kinetic energy of the round or alternatively may incorporate a reactive metal to further increase the incendiary effect.

If the projectile 30 does not engage a target, the self-destruct mechanism functions as in the projectile 10 of FIG. 1 with the tracer charge heating a web of metal between the tracer charge 330 and the self-destruct initiation charge 328 which in turn ignites the explosive charge 326.

Figure 4:
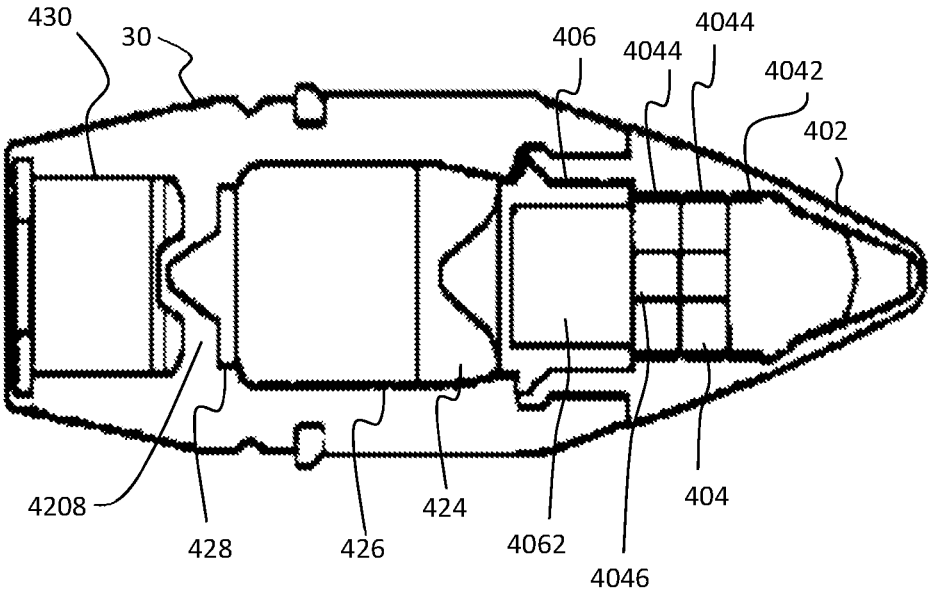
FIG. 4 is a side cross-sectional view of a medium caliber multi-purpose traced self-destruct projectile with a solid closure plug, in accordance with one embodiment.

FIG. 4 is a side cross-sectional view of a medium caliber multi-purpose traced self-destruct projectile with a solid closure plug, in accordance with one embodiment. Alternate closure plug geometries enhance the interaction with the explosive train and cause the explosive to react with more energy. The closure plug 408 further comprises a solid fill 410. The projectile comprises a penetrator tip formed from a heavy metal alloy and a closure plug which incorporates a reactive metal for greater explosive effect.

The projectile 40 is similar to the projectile 10 shown in FIG. 1 with the arrangement of the warhead assembly and tracer assembly being unchanged; however, as will all of the embodiments, the composition and amounts of the charges may be tailored to the specific performance desired. The hardened segmented penetrator 404 comprises two bases 4044 and a penetrator tip 4042 which is formed from a heavy metal alloy. The closure plug 406 includes a hollow cavity filled with reactive metal fill 1062, The addition of the reactive metal fill 1062 interacts with the explosive charge 426 to increase the explosive reaction and performance of the round.

Upon engagement with a target, the energetic chain is initiated and after a predetermined delay, the explosive charge 426 is detonated. The reactive metal fill 4062 interacts with the explosive charge 426 to increase the explosive reaction.

If the projectile 40 does not engage a target, the self-destruct mechanism functions as in the projectile 10 of FIG. 1 with the tracer charge 430 heating a web of metal 4208 between the tracer charge 430 and the self-destruct initiation charge 428 which in turn ignites the explosive charge 426.

Medium Caliber Multi-Purpose Projectile

A medium caliber high rate of fire ammunition round includes an optimized projectile incorporating a hardened penetrator and an explosive fragmenting warhead with a dual-safe fuze. This combination of hardened penetrator and fuzed explosive charge satisfies the dual needs of personnel and materiel defeat in a single round.

The hardened penetrator and the fuzed explosive warhead combine to appropriately time the initiation of the explosive for optimal effectiveness. The hardened penetrator provides target penetration for armored targets without interfering with fuze function. The hardened penetrator is followed by a dual-safe fuze initiated high explosive fragmenting warhead that substantially increases the effectiveness of the projectile against personnel targets. For armored targets, the hardened segment penetrator localizes the kinetic energy of the projectile to increase target penetration prior to the initiation of the high explosive warhead.

The forward nose and penetrator can be arranged in multiple configurations as will be described below. In embodiments of the invention, the hardened penetrator is manufactured with materials including tungsten heavy alloy, reactive material and alloy steel. However, the hardened penetrator is not limited to being manufactured from among these materials. The penetrator translates the target impact forces to appropriately initiate the dual-safe fuze to maximize terminal performance.

As described in further detail below, there are multiple embodiments of the projectile. Four embodiments are shown and described below which utilize a 20×102 mm cartridge configuration as a demonstration platform. Critically, in each of the embodiments, a fuze, hardened penetrator and fragmenting warhead are all packaged in a medium caliber form factor and are capable of delaying detonation until optimal. As will be appreciated by those skilled in the art, the limited volume of medium caliber ammunition may preclude the use of electronic fuzes which are traditionally employed to achieve detonation delay, in the present ammunition round, a mechanical fuze is employed and in combination with the other components of the round, achieves delayed detonation. It is contemplated that battery, technology may progress to a level which allows an electronic fuze to be employed in a medium caliber munition. In such an instance, an electronic fuze may be employed to also provide detonation delay and airburst functionality.

However, the projectile is not limited to use within a 20×102 mm cartridge configuration. Further while the projectile is particularly suited for a medium caliber system, the projectile is not limited to medium caliber ammunition. The projectile may be employed in a small caliber ammunition round or large caliber ammunition round.

Figure 5:
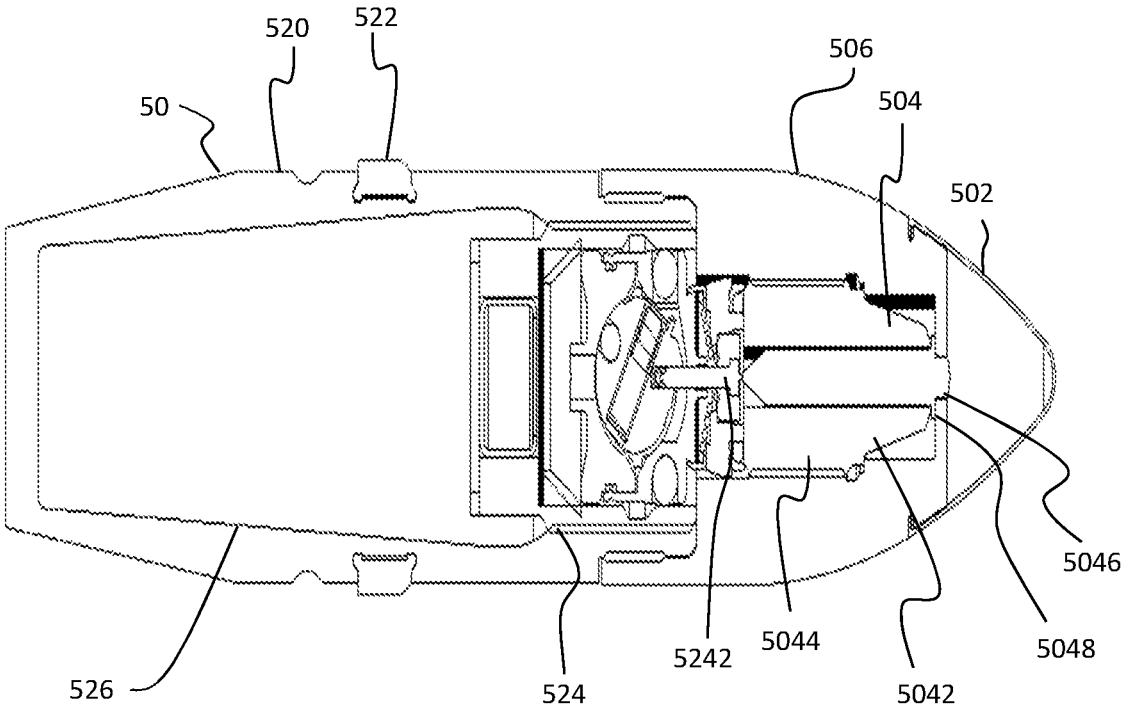
FIG. 5 is a side cross-sectional view of a medium caliber multi-purpose munition for personnel and materiel defeat with a primary striker contained within a tungsten penetrator, in accordance with one embodiment.

FIG. 5 is a side cross-sectional view of a medium caliber multi-purpose munition for personnel and materiel defeat with a primary striker contained within a tungsten penetrator, in accordance with one embodiment. The projectile 50 comprises a forward nose assembly and a warhead assembly.

The warhead assembly is sized and dimensioned to be partially received into a corresponding opening in the rear of the forward nose assembly.

The forward nose assembly further comprises a nose cap 502 at a forward-most end. A nose body 506 encloses a hardened penetrator 504. The hardened penetrator 504 may be an integral piece, as shown in FIG. 5, or may comprise one or more segments.

The nose cap 502 and nose body 506 together provide an aerodynamic surface and house the hardened penetrator 504 during flight. The nose cap 502 is a solid rounded cone and is formed of a material with the necessary material properties to maintain structural integrity during flight but crush under little resistance upon impact. In one embodiment, the nose cap is formed from an aluminum material.

The nose body 506 has a generally frustoconical outer profile and is formed from a material which is relatively lightweight selected to house the penetrator for purposes of weight balance. This allows for proper assembly and rigidity during launch while still allowing the penetrator 504 to penetrate armored targets.

The hardened penetrator 504 is specifically designed to dig into the outer casing of armored targets and prevent the round from ricocheting off of the target. In the embodiment shown in FIG. 5, the penetrator 504 is made of a heavy metal, such as a tungsten alloy. The hardened penetrator 504 comprises a generally conical tip 5042 followed by a cylindrical body 5044. The hardened penetrator 504 defines a hollow central cavity which extends along a longitudinal axis of the hardened penetrator 504 and comprises openings at both forward and rear ends of the penetrator 504.

A primary striker 5046 is enclosed within the central cavity and protrudes from an opening in the forward end of the hardened penetrator 504. The primary striker 5046 is generally cylindrical in shape with a conical aft portion. A support flange 5048 extends radially around the primary striker 5046 near the forward end. The support flange 5048 is in contact with the tip of the hardened penetrator 504 and restrains the striker from rearward translation within the hardened penetrator 504 until impact with a target. A forward end of the primary striker 5046 extends through an opening in the face of the nose body 506 and is in contact with the nose cap 502.

The warhead assembly is rearward of the forward nose assembly. The warhead assembly further comprises a body 520, a driving band 522, a dual safe fuze 524 and an explosive charge 526. The driving band 522 extends around the outer circumference of the warhead body 520.

The warhead body 520 is generally hollow with an enclosed aft end and an opening in the forward end. A stepped down portion at the front of the warhead body 520 is sized to be received within the forward nose assembly. The warhead body 520 fragments upon initiation of the explosive charge 526. The warhead body 520 may be naturally fragmenting or may be designed to fragment along a predefined pattern such as through variations in case width or material properties. For example, in one embodiment, the warhead body 520 may be formed from a plurality of concentric rings with an embossment pattern which fragments in a known pattern upon detonation. In embodiments of the invention, the warhead body 520 is formed from a metal material, such as a steel alloy. In other embodiments, the warhead body may comprise embedded pre-formed fragments in a composite matrix.

The warhead body 520 further defines an interior volume accessed from an opening in the front of the body. A dual-safe mechanical fuze 524 is positioned at the front end, of the main volume with a portion of the fuze 524 protruding through the warhead body 520 and into the forward nose assembly. In one embodiment, the fuze 524 is a point detonating fuze with an optional self-destruct mechanism, such as a self-destruct spring. Self-destruct functionality may improve graze impact sensitivity of the round or provide limited range functionality if needed. In such an embodiment, the self-destruct spring would be positioned rearward of the detonator and would function to detonate the fuze in response to a graze impact or a spin deceleration of the projectile.

The fuze 524 may further comprise a tailorable delay to accommodate different missions and desired delay times. In one embodiment, the length of the fuze striker may be varied to tailor the delay with a defined length corresponding to a delay time.

The fuze 524 is positioned such that a fuze striker 5242 is aligned with the primary striker 5046 such that rearward translation of the primary striker 5046 will cause rearward translation of the fuze striker 5242.

The remaining main interior volume is filled by an explosive charge 526. The explosive charge 526 is in communication with the dual-safe fuze 524. Advantageously, as the explosive charge 526 is initiated by a fuze, the explosive charge may be detonated which increases effectiveness of the fragmenting body.

In operation, a medium caliber ammunition round comprising the projectile 50 is fired from a weapon, usually by electrical or percussion initiation. The projectile 50 is initially seated within a cartridge case further comprising a primer charge and a propelling charge. The initiation ignites the primer charge, which in turn ignites the propellant charge. The propellant burns rapidly to build pressure in the cartridge case and accelerates the projectile 50 down the barrel of the weapon. After the projectile 50 is in motion down the barrel, the projectile 50 exits the barrel and flies toward the target.

Upon engagement with a target, the nose cap 502 of the projectile 50 deforms upon impact with the target to expose the penetrator tip to initiate penetration into the target. The hardened penetrator 504 localizes the kinetic energy of the projectile 50 to increase target penetration. During the penetration event, the impact forces cause the support flange 5048 of the primary striker 5046 to fail which in turn begins the chain for initiation of the explosive charge 526 of the projectile 50. Once the support flange fails 5048, the impact forces the primary striker 5046 to travel rearward and contact the fuze striker 5242. The impact with the primary striker 5046 causes the fuze striker 5242 to initiate the dual-safe fuze 524.

After a delay to allow full entry into the main body of the target, the high explosive 526 is detonated by the dual-safe fuze 524. The dual-safe fuze 524 detonates the explosive charge 526 thereby causing the warhead body 520 to fragment. The delay is tunable to accommodate desired speed of reaction or fuze sensitivity.

The fuze 524 may also comprise a self-destruct mechanism. After a predetermined time, if the projectile 50 does not engage a target, the self-destruct mechanism initiates the fuze 524 which in turn detonates the high explosive charge 526. As described above, the detonation of which causes the warhead body 520 to fragment.

Figure 6:
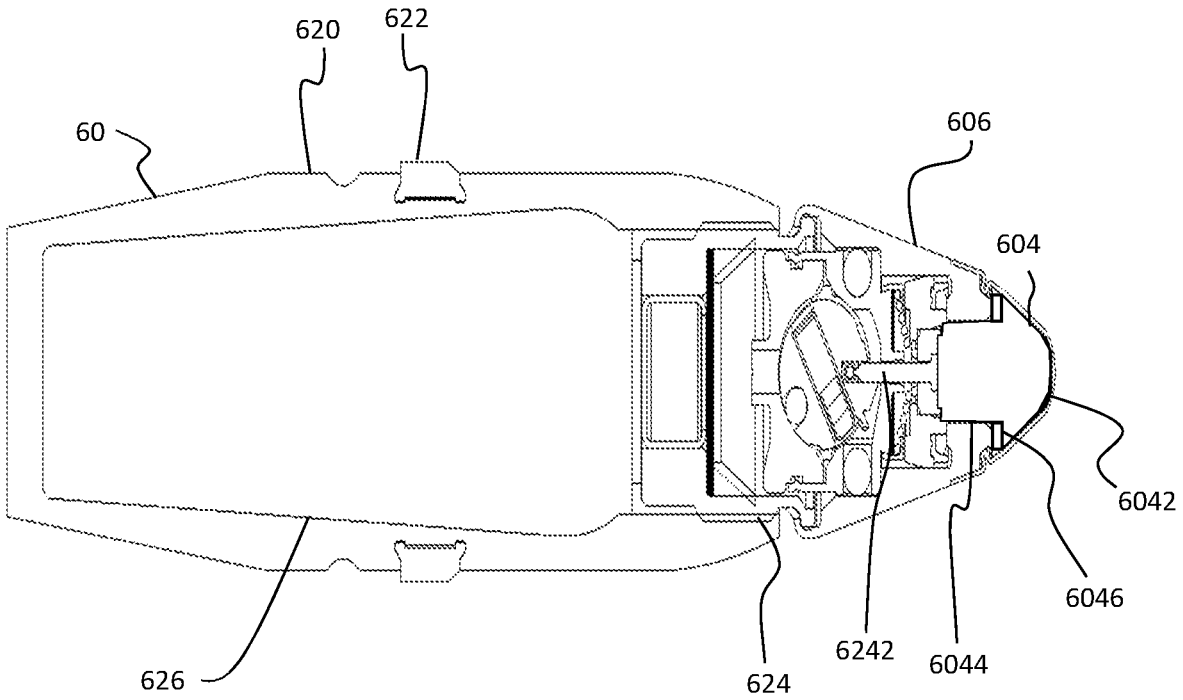
FIG. 6 is a side cross-sectional view of a medium caliber multi-purpose munition for personnel and materiel defeat with a leading tungsten penetrator, in accordance with one embodiment.

FIG. 6 is a side cross-sectional view of a medium caliber multi-purpose munition for personnel and materiel defeat with a leading tungsten penetrator, in accordance with one embodiment. In alternative embodiment, the multi-purpose projectile 60 is initiated through direct impact with a sheared hardened penetrator.

The projectile 60 comprises a forward nose assembly and a warhead assembly connected via a dual-safe fuze 624 which is partially enclosed by both the forward nose assembly and the warhead assembly.

The forward nose assembly further comprises a hardened penetrator 604 at a forward-most end. The hardened penetrator 604 may be a solid integral piece, as shown in FIG. 5. The hardened penetrator 604 is specifically designed to dig into the outer casing of armored targets and prevent the round from ricocheting off of the target. In the embodiment shown in FIG. 6, the penetrator 604 is made of a heavy metal, such as a tungsten alloy. The hardened penetrator 604 comprises a generally conical tip 6042 followed by a cylindrical body 6044. The base of the conical portion 6042 rests on a support washer 6046 and serves as a support rim preventing rearward translation of the hardened penetrator 604 until impact. Impact with a target causes the support washer 6046 to fail thereby allowing the hardened penetrator to move rearward in response to the impact forces.

A nose body 506 is positioned rear of the hardened penetrator 604 which is offset by the support washer. The nose body 506 has a generally frustoconical outer profile and defines a hollow interior which houses the cylindrical portion of the hardened penetrator 604 and a forward portion of the dual-safe fuze 624, The nose body 506 is formed from a material which is relatively lightweight selected to house the penetrator for purposes of weight balance. The hardened penetrator 604 and nose body 506 together provide an aerodynamic surface during flight.

The warhead assembly is rearward of the forward nose assembly. The warhead assembly further comprises a fragmenting body 620, a driving band 622, a dual safe fuze 624 and an explosive charge 626. The driving band 622 extends around the outer circumference of the warhead body 620.

The warhead body 620 is generally hollow with an enclosed aft end and an opening in the forward end. The warhead body 620 functions to fragment upon initiation of the explosive charge 626. The warhead body 620 may be naturally fragmenting or may be designed to fragment along a predefined pattern such as through variations in case width or material properties. For example, in one embodiment, the warhead body 620 may be formed from a plurality of concentric rings with an embossment pattern which fragments in a known pattern upon detonation. In embodiments of the invention, the warhead body 620 is formed from a metal material, such as a steel alloy. In other embodiments, the warhead body may comprise embedded pre-formed fragments in a composite matrix.

The warhead body 620 further defines an interior volume accessed from an opening in the front of the body. A dual-safe fuze 624 is positioned at the front end of the main volume with a portion of the fuze 624 protruding through the warhead body 620 and into the forward nose assembly. In one embodiment, the fuze 624 is a point detonating fuze with an optional self-destruct mechanism, such as a self-destruct spring.

The fuze 624 is positioned such that a fuze striker 6242 is aligned with the cylindrical portion of the hardened penetrator 604 such that rearward translation of the cylindrical portion will cause rearward translation of the fuze striker 6242.

The remaining main interior volume is filled by an explosive charge 626. The explosive charge 626 is in communication with dual-safe fuze 624.

In operation, a medium caliber ammunition round comprising the projectile 60 is fired from a weapon, usually by electrical or procession initiation. The projectile 60 is initially seated within a cartridge case further comprising a primer charge and a propelling charge. The initiation ignites the primer charge, which in turn ignites the propellant charge. The propellant burns rapidly to build pressure in the cartridge case and accelerates the projectile 60 down the barrel of the weapon. After the projectile 60 is in motion down the barrel, the projectile 60 exits the barrel and flies toward the target.

Upon engagement with a target, the hardened penetrator 604 localizes the kinetic energy of the projectile 60 to increase target penetration. During the penetration event, the impact forces cause the support washer 6046 to fail which in turn begins the chain for initiation of the explosive charge 626 of the projectile 60. Once the support washer 6046 fails, the impact forces the hardened penetrator 604 to travel rearward and contact the fuze striker 6242. The impact with the hardened penetrator 604 causes the fuze striker 6242 to initiate the dual-safe fuze 624.

After a delay to allow full entry into the main body of the target, the high explosive 626 is fully initiated by the dual-safe fuze 624. The dual-safe fuze 624 detonates the explosive charge 626 thereby causing the warhead body 620 to fragment.

The fuze 624 may also comprise a self-destruct mechanism. After a predetermined time, if the projectile 60 does not engage a target, the self-destruct mechanism initiates the fuze 624 which in turn detonates the high explosive charge 626. As described above, the detonation of which causes the warhead body 620 to fragment.

Figure 7:
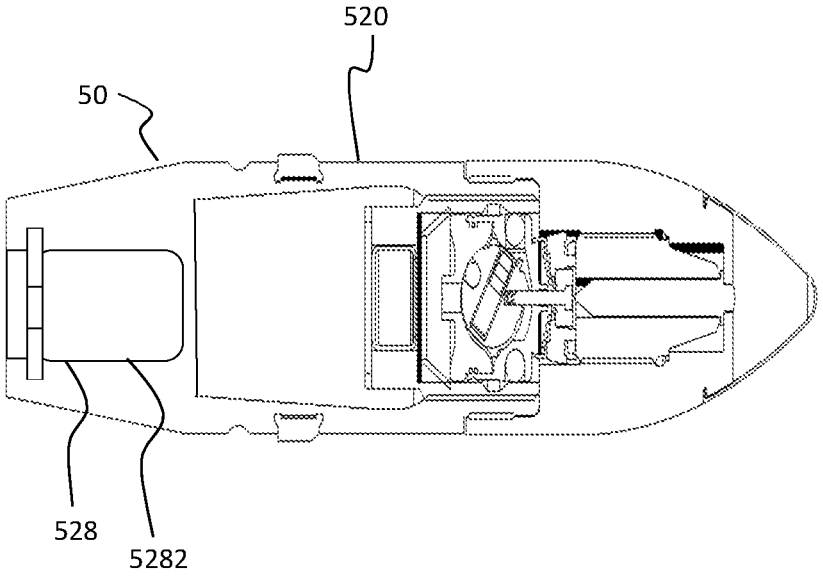
FIG. 7 is a side cross-sectional view of a medium caliber traced multi-purpose munition for personnel and materiel defeat with a primary striker contained within a tungsten penetrator, in accordance with one embodiment.
Figure 8:
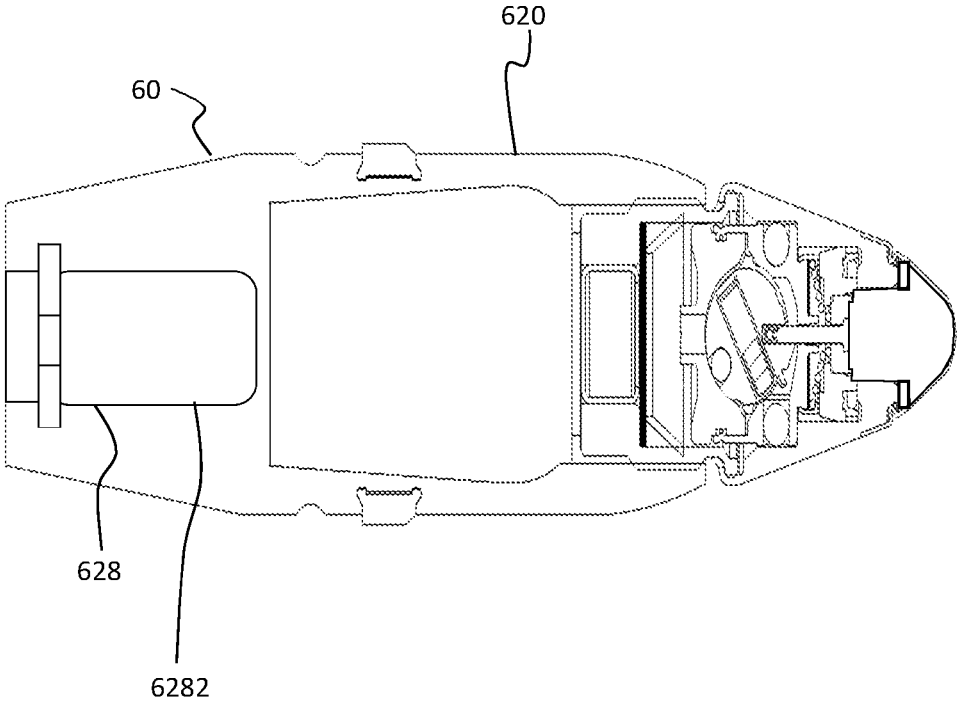
FIG. 8 is a side cross-sectional view of a medium caliber traced multi-purpose munition for personnel and materiel defeat with a leading tungsten penetrator, in accordance with one embodiment.

FIG. 7 is a side cross-sectional view of a medium caliber traced multi-purpose munition for personnel and materiel defeat with a primary striker contained within a tungsten penetrator, in accordance with one embodiment. FIG. 8 is a side cross-sectional view of a medium caliber traced multi-purpose munition for personnel and materiel defeat with a leading tungsten penetrator, in accordance with one embodiment.

In embodiments of the invention, it may be desirable to add a tracer charge to the multi-purpose round to provide an observable signature of the path of the projectile 50, 60. In these embodiments, the warhead body 520, 620 defines an additional interior cavities accessed by an opening in the base of the projectile 50, 60. The cavity in the base of the warhead body 620 contains the tracer assembly 528, 628. The tracer assembly 528, 628 is exposed to the exterior environment through an opening in the base. The tracer assembly 528, 628 further comprises a tracer charge 5282, 6282.

Upon firing, the tracer charge 5282, 6282 is initiated by the burning propellant. During a portion of the flight, the tracer charge 5282, 6282 emits an observable signature, such as a visible signature, through the opening in the base thereby giving an indication of the path of the projectile 50, 60.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile for a medium caliber ammunition round, the projectile comprising:

a nose assembly further comprising a hardened penetrator positioned at a forward end of the nose assembly and further comprising a body having a conical portion and a stepped down cylindrical portion wherein a rear surface of the conical portion forms a support rim, a nose body defining a hollow interior, the hollow interior receiving the cylindrical portion of the hardened penetrator in a forward opening and wherein is in contact with the support rim of the hardened penetrator, and a support washer positioned between the support rim of the hardened penetrator and a forward surface of the nose body thereby offsetting the hardened penetrator from the nose body;

a warhead assembly rearward of the nose assembly and further comprising a fragmenting body defining main cavity with a forward opening, a point detonating fuze with a variable fuze delay partially housed within the main cavity of the fragmenting body and the hollow interior of the nose body, and an explosive charge housed within the fragmenting body; and wherein the support rim prevents rearward axial translation of the hardened penetrator and upon impact with a target, the support washer fails thereby allowing the hardened penetrator to translate rearward in an axial direction thereby engaging a fuze striker to initiate the fuze and detonate the explosive charge after the variable fuze delay.

2. The projectile of claim 1 wherein the hardened segmented penetrator is formed from a tungsten alloy.

3. The projectile of claim 1 wherein the point detonating fuze further comprises dual safeties.

4. The projectile of claim 1 wherein the point detonating fuze further comprises a self-destruct mechanism.

5. The projectile of claim 1 wherein the fragmenting body naturally fragments upon detonation of the explosive charge.

6. The projectile of claim 1 wherein the fragmenting body comprises an embossed fragmentation pattern.

7. The projectile of claim 1 further comprising a tracer charge housed within a cavity in the base of the body for tracing a projectile trajectory.

* * * * *